US008749448B2

(12) United States Patent
Tsou et al.

(10) Patent No.: US 8,749,448 B2
(45) Date of Patent: Jun. 10, 2014

(54) MULTIBAND ANTENNA AND WIRELESS COMMUNICATION DEVICE EMPLOYING THE SAME

(75) Inventors: Tun-Yuan Tsou, New Taipei (TW); Yi-Chieh Lee, New Taipei (TW)

(73) Assignee: Chi Mei Communication Systems, Inc., New Taipei (TW)

( * ) Notice: Subject to any disclaimer, the term of this patent is extended or adjusted under 35 U.S.C. 154(b) by 314 days.

(21) Appl. No.: 13/188,053

(22) Filed: Jul. 21, 2011

(65) Prior Publication Data

US 2012/0274538 A1 Nov. 1, 2012

(30) Foreign Application Priority Data

Apr. 27, 2011 (TW) ..... 100114621 A

(51) Int. Cl.

| | |
|---|---|
| ***H01Q 5/01*** | (2006.01) |
| ***H01Q 9/04*** | (2006.01) |
| ***H01Q 5/00*** | (2006.01) |
| *H01Q 1/24* | (2006.01) |

(52) U.S. Cl.

CPC ..... *H01Q 5/0065* (2013.01); *H01Q 1/241* (2013.01); *H01Q 5/0058* (2013.01); *H01Q 5/0068* (2013.01)

USPC ..... 343/876

(58) Field of Classification Search

CPC ... H01Q 1/243; H01Q 5/0058; H01Q 5/0065; H01Q 5/0068

USPC ..... 343/876, 702

See application file for complete search history.

(56) References Cited

U.S. PATENT DOCUMENTS

| | | | | |
|---|---|---|---|---|
| 7,425,924 | B2 * | 9/2008 | Chung et al. | 343/702 |
| 8,466,844 | B2 * | 6/2013 | Ying | 343/752 |
| 2010/0164812 | A1 * | 7/2010 | Ganeshan et al. | 343/702 |

OTHER PUBLICATIONS

"Antenna Frequency Scaling", The ARRL Antenna Book; The American Radio Relay League, 1988, pp. 2-24 to 2-25.*

* cited by examiner

*Primary Examiner* — Robert Karacsony
*Assistant Examiner* — Amal Patel
(74) *Attorney, Agent, or Firm* — Novak Druce Connolly Bove + Quigg LLP

(57) ABSTRACT

A multiband antenna in a wireless communication device includes a main antenna, a first parasitic portion, a second parasitic portion, a first switch, and a second switch, the first switch is used to control functioning of the first parasitic portion. The second switch is used to control functioning of the second parasitic portion. Therefore, the main antenna can resonate alone or in combination with the functioning first parasitic portion and/or the functioning second parasitic portion, the multiband antenna has different operating frequency bands and different operating SAR.

10 Claims, 3 Drawing Sheets

MULTIBAND ANTENNA AND WIRELESS COMMUNICATION DEVICE EMPLOYING THE SAME

BACKGROUND

1. Technical Field

The present disclosure relates to antennas, and particularly to a multiband antenna used in a wireless communication device.

2. Description of Related Art

Many portable electronic devices, such as mobile phones, personal digital assistants, and laptop computers often use multiband antennas to receive/send wireless signals of different frequencies.

However, multiband antennas usually have an unvaried Specific Absorption Rate (SAR), which makes them difficult to satisfy different countries/areas standard of SAR.

Therefore, there is room for improvement within the art.

BRIEF DESCRIPTION OF THE DRAWINGS

Many aspects of the present multiband antenna and wireless communication device employing the same can be better understood with reference to the following drawings. The components in the various drawings are not necessarily drawn to scale, the emphasis instead being placed upon clearly illustrating the principles of the present multiband antenna. Moreover, in the drawings, like reference numerals designate corresponding parts throughout the figures.

DETAILED DESCRIPTION

Figure 3:
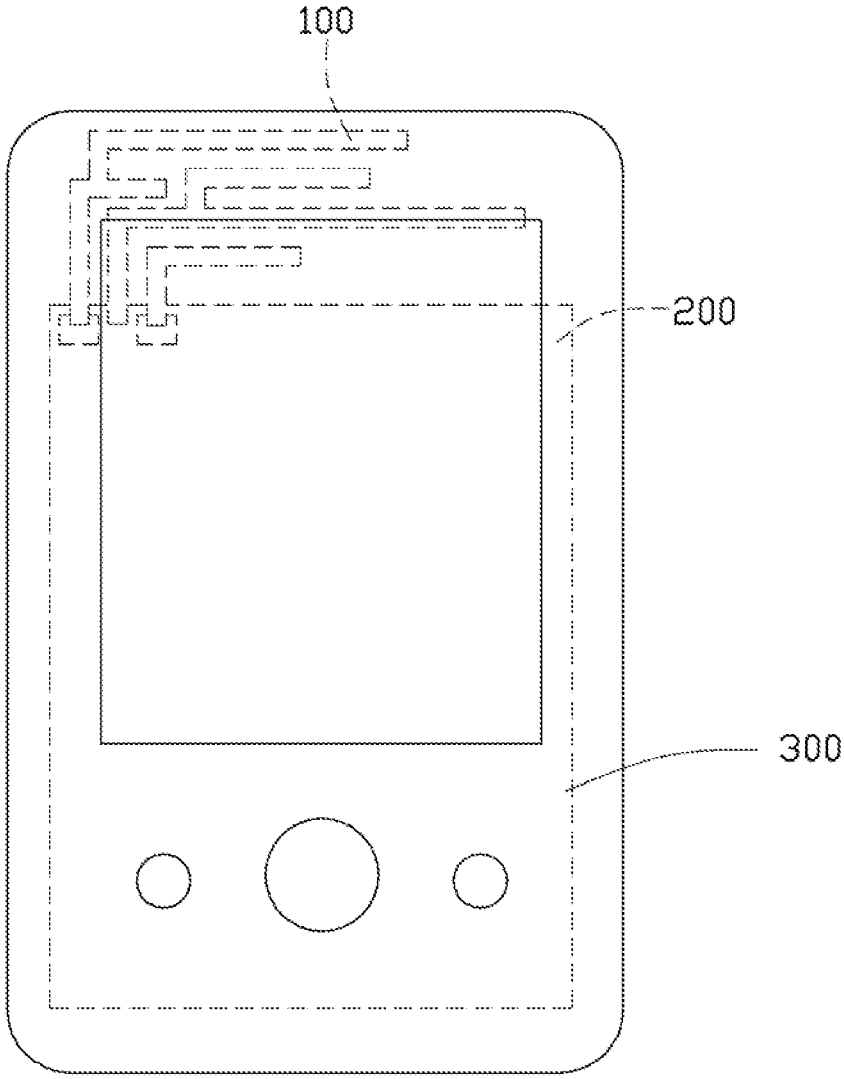
FIG. 3 is a schematic view of a wireless communication device including a multiband antenna, according to an exemplary embodiment.

FIG. 3 is a schematic showing a wireless communication device 300 including a multiband antenna 100, according to an exemplary embodiment. The wireless communication device 300 can be a mobile phone, a personal digital assistant (PDA), or a laptop computer. The wireless communication device 300 includes a Printed Circuit Board (PCB) 200 and a multiband antenna 100 positioned on the PCB 200. The multiband antenna 100 consists of conductive sheets, with a size and profile minimized, to be suitable for use in the wireless communication device 300. In this embodiment, the multiband antenna 100 electronically connects to the PCB 200, and can receive/send wireless signals of different frequencies.

Figure 1:
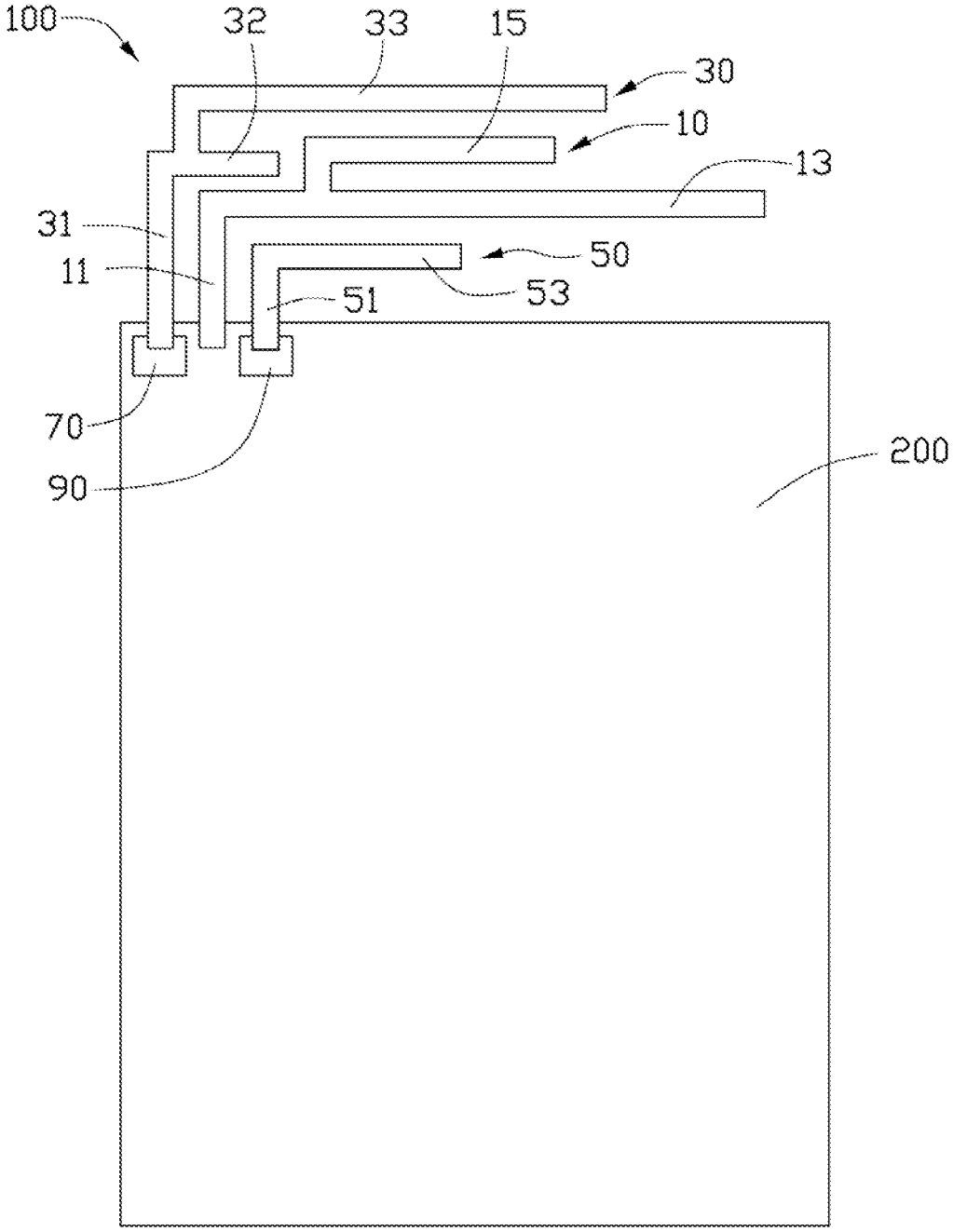
FIG. 1 is a schematic view of a multiband antenna, according to an exemplary embodiment.

FIG. 1 schematically shows a multiband antenna 100. The multiband antenna 100 includes a main antenna 10, a first parasitic portion 30, a second parasitic portion 50, a first switch 70 and a second switch 90. Because of the schematic depiction of the drawings and the potential unitary construction, the precise beginnings and ends of various parts of the antenna do not need to be exactly as depicted in this disclosure. The main antenna 10 connects to the PCB 200. The first parasitic portion 30 and the second parasitic portion 50 are located on two opposite sides of the main antenna 10. The first parasitic portion 30 and the second parasitic portion 50 can optionally connect to the PCB 200 by the first switch 70 and the second switch 90, to couple and resonate different frequency bands in combination with the main antenna 10, to satisfy the frequency standard of different countries/areas. Furthermore, when the main antenna 10 alone, or the main antenna 10 resonates with the first parasitic portion 30 and/or the second parasitic portion 50 together, the multiband antenna 100 has different SAR, which makes the multiband antenna 100 satisfy the SAR standard of different countries/areas.

The main antenna 10 includes a feed portion 11, a radiator portion 13, and a extension portion 15. The extension portion 15 and the radiator portion 13 are substantially coplanar with the feed portion 11. The main antenna 10 connects to the PCB 200 by the feed portion 11. Both the feed portion 11 and the radiator portion 13 are generally rectangular plates. The radiator portion 13 perpendicularly extends from the end of the feed portion 11. The extension portion 15 is substantially an L-shape plate, perpendicularly extending from one side of the radiator portion 13 for a distance, and perpendicularly formed to be parallel to the radiator portion 13.

The first parasitic portion 30 includes a first ground portion 31, a connecting portion 32, and a first parasitic unit 33, the connecting portion 32 connects the first ground portion 31 and the first parasitic unit 33. The first ground portion 31 is generally a rectangular plate. The first ground portion 31 is parallel to the feed portion 11, and connected to the first switch 70, to optionally connect the first parasitic portion 30 to ground via the first switch 70. Therefore, the first ground portion 31 can resonate a frequency mode in combination with the main antenna 10. The connecting portion 32 is substantially a rectangular plate. The connecting portion 32 is perpendicular to the end of the first ground portion 31. The first parasitic unit 33 is an L-shape plate, perpendicularly extending from one side of the connecting portion 32, and then perpendicularly formed to be parallel to the connecting portion 32. The first parasitic unit 33, the connecting portion 32, and the first ground portion 31 are coplanar with the main antenna 10, the end of the first parasitic unit 33 extends to exceed beyond the end of the extension portion 15.

The second parasitic portion 50 includes a second ground portion 51 and a second parasitic unit 53. The second ground portion 51 is generally a rectangular plate. The second ground portion 51 is parallel to both the feed portion 11 and the first ground portion 31, the second ground portion 51 is positioned at the opposite side of the feed portion 11. The second ground portion 51 is connected to the second switch 90, to optionally connect the second parasitic portion 50 to ground via the second switch 90. The second parasitic portion 50 can only resonate a frequency band in combination with the main antenna 10, or in combination with both the first parasitic portion 30 and the main antenna 10. The second parasitic unit 53 is a rectangular plate, that perpendicularly extends from the end of the second portion 51 in the direction away from the feed portion 11. Therefore the second parasitic unit 53 is parallel to the radiator portion 13.

Both the first switch 70 and the second switch 90 have two states: on and off. Both the first switch 70 and the second switch 90 connect to ground when they are on, and both the first switch 70 and the second switch 90 are open when they are off. The first parasitic portion 30 or the second parasitic portion 50 can connect to ground or keep an open state correspondingly. In one embodiment, both the first switch 70 and the second switch 90 are controlled by software set in the portable electronic device 300. The first switch 70 has four state combinations in combination with the second switch 90. Appropriately the multiband antenna 100 has four working states.

Figure 2:
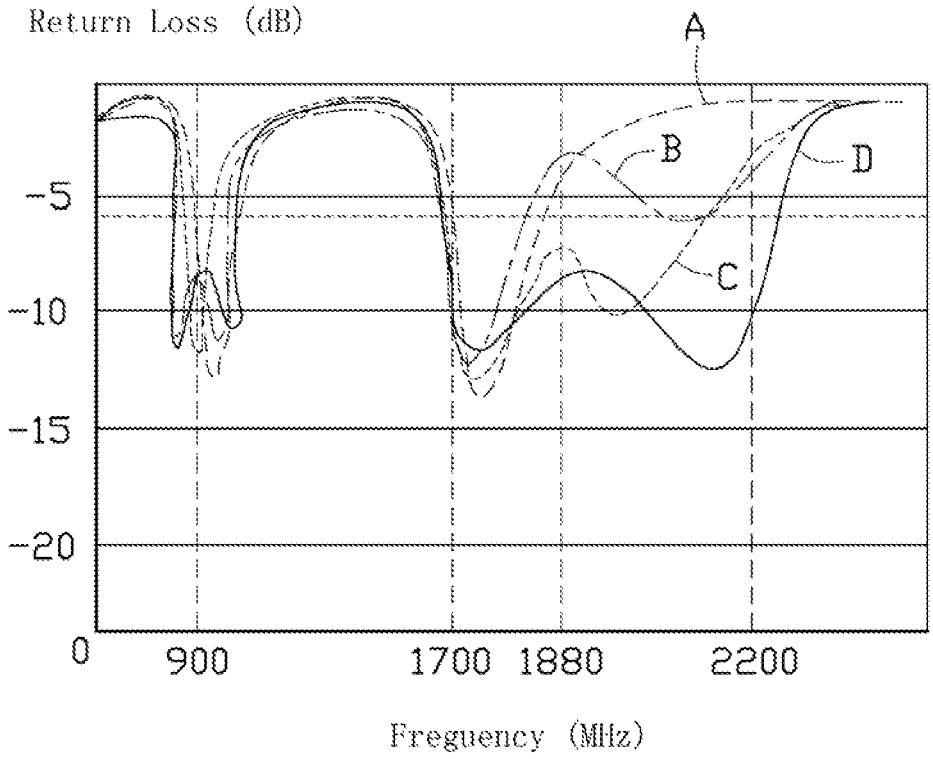
FIG. 2 is a diagram showing return loss measurement of the multiband antenna shown in FIG. 1.

Referring to FIG. 2, as shown in the experiments, the return loss (RL) of the multiband antenna 100 is acceptable when the multiband antenna 100 receives/sends wireless signals in four different working states. The curve A shows the RL of the multiband antenna 100, when both the first switch 70 and the second switch 90 are off. The curve B shows the RL of the multiband antenna 100, when the first switch 70 is on, while the second switch 90 is off. The curve C shows the RL of the multiband antenna 100, when the first switch 70 is off, while the second switch 90 is on. The curve D shows the RL of the multiband antenna 100, when both the first switch 70 and the second switch 90 are on.

As shown in the curve A in FIG. 2, when both the first switch 70 and the second switch 90 are off, wireless signals access into the main antenna 10 from the feed portion 11, and the radiator portion 13 resonates a frequency mode in low frequency (LF). In addition, the extension portion 15 resonates a frequency mode in high frequency (HF). The RL of the multiband antenna 100 is less than −5 dB when the multiband antenna 100 receives/sends wireless signals at GSM900, DCS1800, and WCDMA-Band 8 (the same frequency of GSM900). As shown the curve B in FIG. 2, when the first switch 70 is on, and the second switch 90 is off, wireless signals accessing the main antenna 10 from the feed portion 11, not only can the radiator portion 13 resonate a frequency mode in LF, the extension portion 15 can resonate a frequency mode in HF. In addition, the first parasitic portion can resonate a frequency mode in LF and a frequency mode in HF in combination with the main antenna 10. The RL of the multiband antenna 100 is less than −5 dB when the multiband antenna 100 receives/sends wireless signals at GSM850, GSM900, DCS1800, PCS1900, and WCDMA-Band 5 (the same frequency of GSM850). WCDMA-Band 8 (the same frequency of GSM900). WCDMA-Band 4 (the same frequency of DCS1800), and WCDMA-Band 2 (the same frequency of PCS1900). As shown the curve C in FIG. 2, when the first switch 70 is off, while the second switch 90 is on, the RL of the multiband antenna 100 is less than −5 dB when the multiband antenna 100 receives/sends wireless signals at GSM900, DCS1800, PCS1900, and WCDMA-Band 8, WCDMA-Band 4, WCDMA-Band 2, WCDMA-Band 1. As shown the curve D in FIG. 2, when both the first switch 70 and the second switch 90 are on, the RL of the multiband antenna 100 is less than −5 dB when the multiband antenna 100 receives/sends wireless signals at DCS1800, PCS1900, WCDMA-Band4, WCDMA-Band2, and WCDMA-Band1.

Therefore, the multiband antenna 100 can be adjusted to satisfy different countries/areas standard of SAR and wireless communication frequencies. As shown in TABLE 1, in the following embodiment, take North America, Europe and China as an illustration.

TABLE 1 the wireless communication frequencies and SAR of the multiband antenna in North America, Europe and China

| | SW1 off SW2 off | SW1 on SW2 off | SW1 off SW2 on | SW1 on SW2 on |
|---|---|---|---|---|
| Wireless Communication Frequency | — | GSM850 | — | GSM850 |
| | GSM900 | GSM900 | GSM900 | GSM900 |
| | DCS1800 | DCS1800 | DCS1800 | DCS1800 |
| | — | PCS1900 | PCS1900 | PCS1900 |
| | — | Band 5 | — | Band 5 |
| | Band 8 | Band 8 | Band 8 | Band 8 |
| | — | Band 4 | Band 4 | Band 4 |
| | — | Band 2 | Band 2 | Band 2 |
| | — | — | Band 1 | Band 1 |
| SAR in North America | — | <1.6 | — | >1.6 |
| SAR in Europe | — | — | <2.0 | <2.0 |
| SAR in China | <2.0 | <2.0 | <2.0 | <2.0 |

In TABLE 1, the SE1 stands for the first switch 70, the SE2 stands for the second switch 90, and the unit of SAR is mW/1 g.

North American wireless communication frequencies are GSM850, PCS1900, WCDMA-Band 5, WCDMA-Band 2, and WCDMA-Band 4. European wireless communication frequencies are GSM900, DCS1800, WCDMA-Band 1, and WCDMA-Band 8. Chinese wireless communication frequencies are mainly GSM900, and DCS1800. The North American standard of SAR is lower than 1.6 mW/1 g, both the European standard and Chinese standard of SAR are lower than 2.0 mW/1 g.

Therefore, we can make a conclusion below from the TABLE 1: When both the first switch 70 and the second switch 90 are off, the multiband antenna 100 can not cover all of the North American wireless communication frequencies or all of the European wireless communication frequencies, it only can cover the Chinese wireless communication frequencies. Therefore, the multiband antenna 100 is only suitable for China in this state. When the first switch 70 is on, the second switch 90 is off; the multiband antenna 100 can cover both North American and Chinese wireless communication frequencies but not European. Furthermore, the SAR of the multiband antenna 100 in North America is lower than 1.6mW/1 g, and China is lower than 2.0 mW/1 g. Therefore, the multiband antenna 100 is suitable for both North America and China in this state. When the first switch 70 is off and the second switch 90 is on, the multiband antenna 100 can cover both European and Chinese wireless communication frequencies but not the North American wireless communication frequencies. Furthermore, the SAR of the multiband antenna 100 in both the European and the Chinese are lower than 2.0 mW/1 g. Therefore, the multiband antenna 100 is suitable for both European and Chinese in this state. When both the first switch 70 and the second switch 90 are on, the multiband antenna 100 can cover North American, European and Chinese wireless communication frequencies. Nevertheless, the SAR of the multiband antenna 100 in North America is higher than 1.6 mW/1 g, and the SAR of the multiband antenna 100 in both Europe and China are lower than 2.0mW/1 g. Therefore, the multiband antenna 100 is not suitable for North America, but only suitable for Europe and China in this state.

Obviously, this multiband antenna 100 connects the first parasitic portion 30 or the second parasitic portion 50 to ground via adjusting the first switch 70 or the second switch 90 to be on. Thereafter, the first parasitic portion 30 or the second parasitic portion 50 can couple and resonate, different frequency bands in combination with the main antenna 10. And the multiband antenna 100 has different SAR according to the four state combinations of the first switch 70 and the second switch 90, which makes the wireless communication device 300 using the multiband antenna 100 not only have ability of receiving/sending signals in different countries/areas, but also can satisfy different SAR standards. Therefore the multiband antenna 100 can be used frequently and conveniently.

It is to be further understood that even though numerous characteristics and advantages of the present embodiments have been set forth in the foregoing description, together with details of structures and functions of various embodiments, the disclosure is illustrative only, and changes may be made in detail, especially in matters of shape, size, and arrangement of parts within the principles of the present invention to the full extent indicated by the broad general meaning of the terms in which the appended claims are expressed.

What is claimed is:

1. A multiband antenna, comprising:

a main antenna comprising a feed portion, a radiator portion, and an extension portion, the radiator portion and the extension portion being coplanar with the feed portion, and the radiator portion perpendicularly extending from the end of the feed portion, the extension portion perpendicularly extending from one side of the radiator portion, and perpendicularly formed to be parallel to the radiator portion;

a first parasitic portion;

a second parasitic portion;

a first switch used to control functioning of the first parasitic portion; and a second switch used to control functioning of the second parasitic portion;

wherein the main antenna is configured to resonate, either or both of the first parasitic portion and second parasitic portion are configured to resonate with the main antenna, the multiband antenna accordingly has different operating frequency bands and different operating SAR depending upon which antenna elements are resonating;

wherein the first parasitic portion comprises a first ground portion, a connecting portion and a first parasitic unit, the first parasitic unit connects to the first switch by the first ground portion, the first ground portion is parallel to the feed portion, the connecting portion perpendicularly extends from the end of the first ground portion, and extends towards the extension portion of the main antenna, the first parasitic unit perpendicularly extends from one side of the connecting portion for a distance, and then is perpendicularly formed to be parallel to the connecting portion;

wherein the second parasitic portion includes a second ground, and a second parasitic unit, the second parasitic unit connects to the second switch by the second ground portion, the second ground portion is parallel to the feed portion, and the second parasitic unit perpendicularly extends from the end of the second portion, and extends in the direction away from the feed portion; and wherein the first switch connects the first parasitic portion to ground to enable the first parasitic portion, and the second switch connects the second parasitic portion to ground to enable the second parasitic portion, both the first switch and the second switch have on and off states: the first switch's on state connects the first parasitic portion to ground; and the second switch's on state connects the second parasitic portion to ground, when the first switch is on and the second switch is off, the main antenna in combination with the first parasitic portion resonate to receive or send wireless signals at GSM850, GSM900, DCS1800, PCS1900, WCDMA-Band 5, WCDMA-Band 8, WCDMA-Band 4, and WCDMA-Band 2.

2. The multiband antenna as claimed in claim 1, wherein the first parasitic portion and the second parasitic portion are located on the opposite sides of the main antenna.

3. The multiband antenna as claimed in claim 1, wherein when both the first switch and the second switch are off, the main antenna resonates to receive/send wireless signals at GSM900, DCS1800, and WCDMA-Band 8.

4. The multiband antenna as claimed in claim 1, wherein when the first switch is off and the second switch is on, the main antenna in combination with the second parasitic portion resonate to receive/send wireless signals at GSM900, DCS1800, PCS1900, and WCDMA-Band 8, WCDMA-Band 4, WCDMA-Band 2, WCDMA-Band 1.

5. The multiband antenna as claimed in claim 1, wherein when both the first switch and the second switch are on, the main antenna in combination with both the first parasitic portion and the second parasitic portion resonate to receive/send wireless signals at GSM850, GSM900, DCS1800, PCS1900, and WCDMA.

6. A wireless communication device, comprising:

a PCB; and a multiband antenna positioned on the PCB, comprising a main antenna comprising a feed portion, a radiator portion, and an extension portion, the radiator portion and the extension portion being coplanar with the feed portion, and the radiator portion perpendicularly extending from the end of the feed portion, the extension portion perpendicularly extending from one side of the radiator portion, and perpendicularly formed to be parallel to the radiator portion;

a first parasitic portion;

a second parasitic portion;

a first switch used to control functioning of the first parasitic portion; and a second switch used to control functioning of the second parasitic portion;

wherein the main antenna is configured to resonate, either or both of the first parasitic portion and the second parasitic portion are configured to resonate with the main antenna, the multiband antenna of the wireless communication device accordingly has different operating frequency bands and different operating SAR depending upon which antenna elements are resonating;

wherein the first parasitic portion comprises a first ground portion, a connecting portion and a first parasitic unit, the first parasitic unit connects to the first switch by the first ground portion, the first ground portion is parallel to the feed portion, the connecting portion perpendicularly extends from the end of the first ground portion, and extends towards the extension portion of the main antenna, the first parasitic unit perpendicularly extends from one side of the connecting portion for a distance, and then is perpendicularly formed to be parallel to the connecting portion; and wherein the second parasitic portion includes a second ground, and a second parasitic unit, the second parasitic unit connects to the second switch by the second ground portion, the second ground portion is parallel to the feed portion, and the second parasitic unit perpendicularly extends from the end of the second portion, and extends in the direction away from the feed portion; and wherein the first switch connects the first parasitic portion to ground to enable the first parasitic portion, and the second switch connects the second parasitic portion to ground to enable the second parasitic portion, when the first switch is on, the second switch is off, the main antenna in combination with the first parasitic portion resonate to receive or send wireless signals at GSM850, GSM900, DCS1800, PCS1900, WCDMA-Band 5, WCDMA-Band 8, WCDMA-Band 4, and WCDMA-Band 2.

7. The wireless communication device as claimed in claim 6, wherein both the first switch and the second switch have on and off states: and the first switch's on state connects the first parasitic portion to ground; and the second switch's on state connects the second parasitic portion to ground.

8. The wireless communication device as claimed in claim 6, wherein when both the first switch and the second switch are off, the main antenna resonates to receive/send wireless signals at GSM900, DCS1800, and WCDMA-Band 8.

9. The wireless communication device as claimed in claim 6, wherein when the first switch is off and the second switch is on, the main antenna in combination with the second parasitic portion resonate to receive/send wireless signals at GSM900, DCS1800, PCS1900, and WCDMA-Band 8, WCDMA-Band 4, WCDMA-Band 2, WCDMA-Band 1.

10. The wireless communication device as claimed in claim 6, wherein when both the first switch and the second switch are on, the main antenna in combination with both the first parasitic portion and the second parasitic portion resonate to receive/send wireless signals at GSM850, GSM900, DCS1800, PCS1900, and WCDMA.

* * * * *